United States Patent [19]

Willis

[11] 4,149,745

[45] Apr. 17, 1979

[54] REFUSE COLLECTING DEVICE

[76] Inventor: J. Don Willis, 301 E. Lawrence Rd., Phoenix, Ariz. 85012

[21] Appl. No.: 882,363

[22] Filed: Mar. 1, 1978

[51] Int. Cl.[2] ..... A01B 1/04

[52] U.S. Cl. ..... 294/55; 294/1 R; 15/257.1

[58] Field of Search ..... 294/55, 1 R, 19 R; 248/99, 100, 106; 119/1R; 43/11, 12; 141/108; 15/257.1, 257.4, 257.6, 257.7, 257.8

[56] References Cited

U.S. PATENT DOCUMENTS

| | | | |
|---|---|---|---|
| 3,872,831 | 3/1975 | Cassidy | 294/55 |
| 3,986,744 | 10/1976 | Krogstad et al. | 294/55 |
| 4,012,067 | 3/1977 | Travis | 294/19 R |

*Primary Examiner*—James B. Marbert

*Attorney, Agent, or Firm*—Cahill, Sutton & Thomas

[57] ABSTRACT

A hollow cylindrical scoop-shaped device facilitates scooping of solid and semi-solid refuse off hard ground or vegetation covered ground through manipulation of the device by a directly attached handle or by an extended handle. The refuse scooped is collected in a detachably attached trailing disposable conventional paper sack. A clamp secures any sized opening paper sack and a guard about the bottom of the device receives the lower edge of the sack to prevent tearing and/or wetting thereof during use of the device.

6 Claims, 3 Drawing Figures

REFUSE COLLECTING DEVICE

The present invention relates to refuse collecting devices and, more particularly, to devices for collecting the feces of pets.

Periodically and usually daily, home owners who have pets, such as dogs and cats, must remove the feces of their pets from their yards. Often, the feces is picked up with a spade, shovel, hand trowel, or the like. Thereafter, the feces is placed within a container of some sort and ultimately dumped in a garbage can or toilet. These implements are reasonably satisfactorily useable but the process is more cumbersome than need be. Additionally, for those persons who, because of physical fraility or injury, cannot easily stoop or bend over, adequate manipulation of the implements may be difficult. Moreover, the process of depositing the picked-up feces into a container is cumbersome and at best, somewhat awkward.

Many municipalities, particularly those without a large park system, impose severe fines upon the owners of pets who allow their pets to defecate on the sidewalk. Accordingly, these owners, who exercise their pets on public sidewalks, must carry with them some means for retrieving their pet's feces or else be subject to substantial fines.

In any neighborhood, there are, despite the most stringent leash laws, animals which roam unattended. Necessarily, these animans defecate on front lawns other than that of their owner's. The results are not only unsightly but also hazardous to health. Removal of such feces must be effected by the owner.

The following United States Letters Patents are representative of various types of devices which have been invented and which are generally related to the present invention: U.S. Pat. Nos. 3,659,891, 3,703,158, 3,740,086, 3,744,453, 3,754,785, 3,757,737, 3,777,708, 3,804,448, 3,830,423, 3,868,135 and 3,986,744.

While these devices will, to a greater or a lesser extent, accomplish the purposes sought, they suffer from various mechanical and operational deficiencies. In example, some of the devices require specially constructed and formed collection bags; thereby, bags readily available in one's household cannot be employed. Some of the devices have attachment mechanisms for the collection bags which renders detachment of the filled collection bag difficult or which renders it necessary to physically contact the portions of the device which have come in contact with the feces picked up. Some of the devices have no means for protecting the edges of the bag opening from contacting rough ground surfaces and tearing. Others of the devices, because of the nature of the receiving opening, render it essentially physically impossible to collect feces from vegetation covered ground without strenuous manipulation. A few of the devices require that the feces be collected during the act of defecation; a seemingly absurd requirement in most situations. For those devices which have no removable collection bag, the cleaning required to remove the collected feces is extremely distasteful, particularly if the user does not live in a house where outside faucets are available.

The present invention was developed with full knowledge of the state of the prior art and particular emphasis was directed toward the development of a device which is first of all functionally adequate, employs disposable collection bags of the type available in any household and may be used upon any surface by a directly attached handle or by an extended handle.

It is therefore a primary object of the present invention to provide a device for collecting animal feces in a disposable collection bag.

Another object of the present invention is to provide a refuse collection device which may be operated by manipulation of a directly attached handle or by manipulation of an extended handle.

Yet another object of the present invention is to provide a refuse collecting device which detachably attaches any sized conventional paper sack.

Yet another object of the present invention is to provide an attachment mechanism in a refuse collecting device which protects the edge of a collecting bag against tearing and wetting.

A further object of the present invention is to provide a refuse collecting device having a scoop snout for directing the collected matter into a trailing collection bag.

A yet further object of the present invention is to provide a cylindrically shaped refuse collecting device which includes a guard for protecting the lower segment of the opening of an attached encircling and trailing paper bag.

A still further object of the present invention is to provide an attachment mechanism for the collection bag of a refuse collecting device which includes a guard to protect the lower edge of the collecting bag and a clamp for securely clamping the bag to the device regardless of the opening size of the bag.

These and other objects of the present invention will become apparent to those skilled in the art as the description thereof proceeds.

The present invention may be described with greater specificity and clarity with reference to the following drawings, in which.

Figure 1:
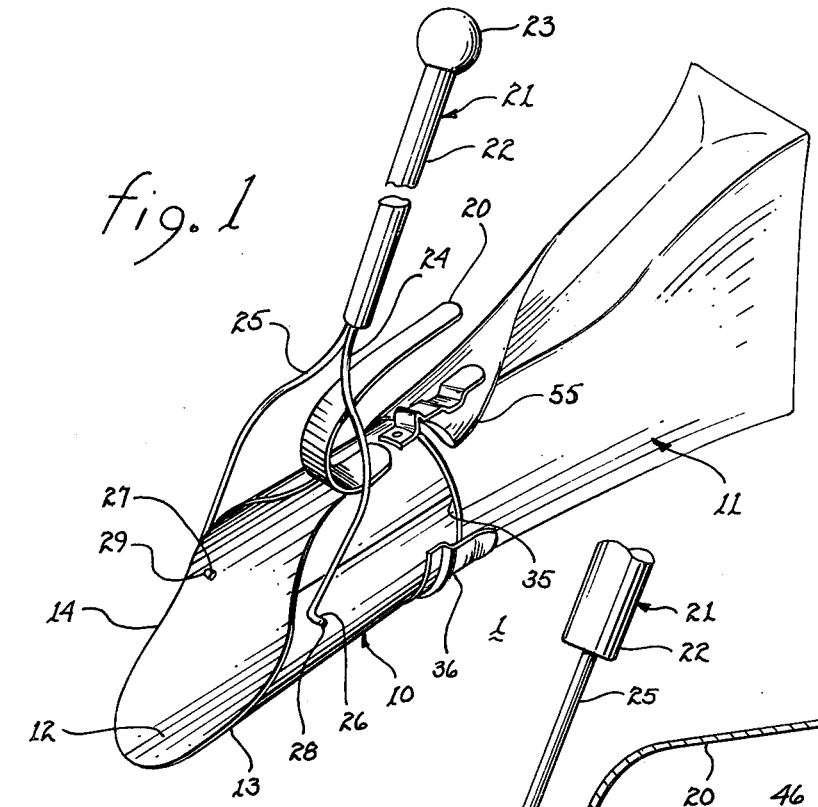
FIG. 1 is a perspective view of the refuse collecting device.

Referring to FIG. 1, there is shown a refuse collecting device 1 having a scoop 10 and a trailing collection bag 11. The scoop includes a forwardly extending snout 12 having its forwardmost point at the bottom center line of the scoop. Rearwardly of the forwardmost point, edges 13 and 14 extend laterally upwardly and thence inwardly to define the overall cylindrical configuration of scoop 10. With this configuration of the forward end of the scoop, it is easy to penetrate ground covering vegetation to retrieve feces and yet the capability of retrieving feces off hard surfaces is not impaired. The use of an overall cylindrical configuration of the scoop has several advantages. First, sheet metal is readily formed into a cylinder by conventional and inexpensive processes. Second, the cylindrical configuration, aside from the material employed itself, lends a certain resiliency to the scoop not available from rectangular or triangular cross-sectional configurations.

Figure 3:
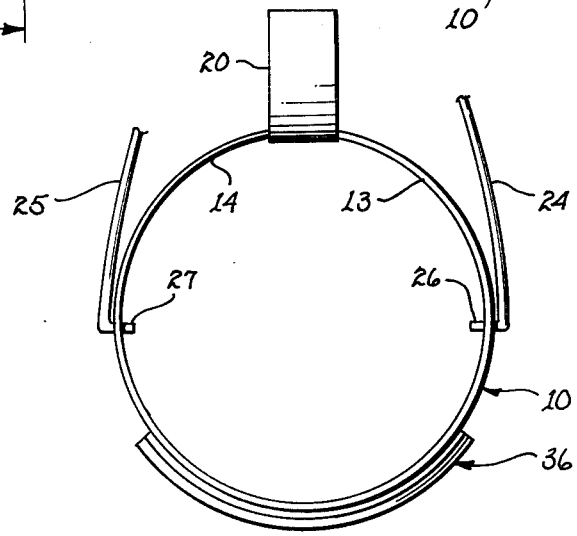
FIG. 3 is a front view, taken along lines 3—3, as shown in FIG. 2.

A handle 20, which may be of bent sheet material as illustrated, is rigidly attached to the upper surface of scoop 10. This handle permits direct manipulation of the scoop to retrieve feces. An extended handle 21, which is detachably attached to scoop 10 may be employed by those persons who cannot stoop or bend over sufficiently to use handle 20. Extended handle 21 includes a shaft 22 having a handle or knob 23 disposed at the upper end thereof. Wire elements 24 and 25 extend downwardly from the lower end of handle 22 to straddle scoop 10 (see FIG. 3). Ends 26 and 27 of these wire elements are bent inwardly toward one another for penetrating engagement with apertures 28 and 29 disposed in opposed sides of scoop 10. By positioning apertures 28 and 29 forward of the center of gravity of refuse collecting device 1, lifting of the device by extended handle 21 will cause a downward tilting of the rear end of the scoop and encourage translation of any collected refuse from snout 12 into collecting bag 11.

Figure 2:
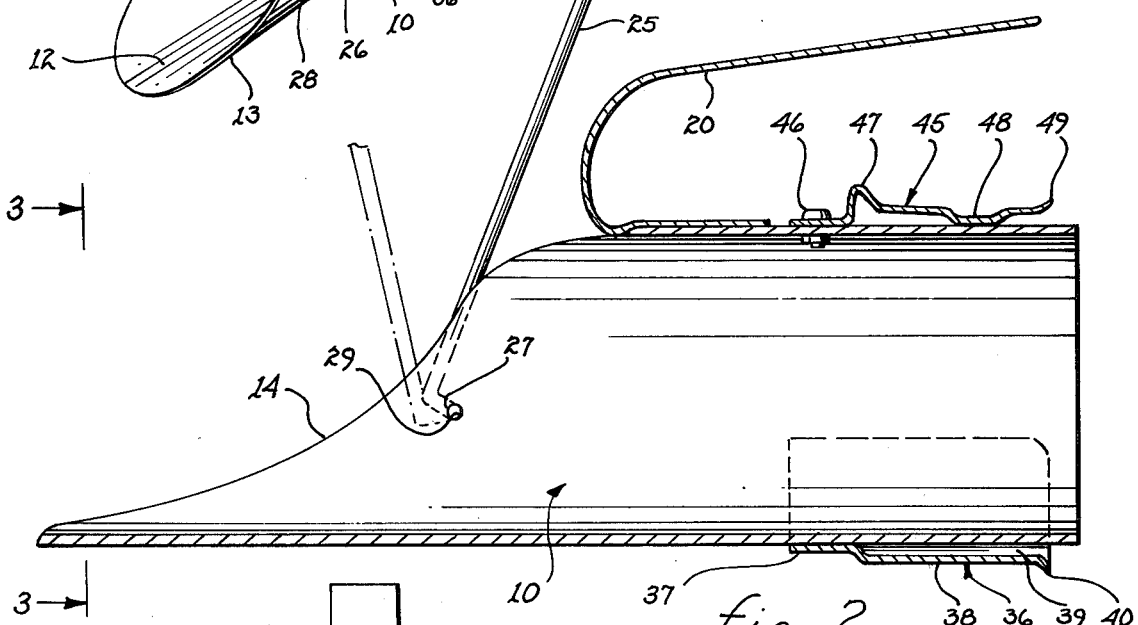
FIG. 2 is a cross-sectional view taken along the longitudinal axis of the device.

Referring particularly to FIGS. 1 and 2, the means for attaching collecting bag 11 will be described. Every household has surplus paper bags which are obtained during purchases at stores. These bags come in a variety of sizes. Additionally, many items are purchased which are already encased within plastic bags, which plastic bags also come in various sizes. To render refuse collecting device 1 as utilitarian as possible, the mechanism for attaching collection bag 11 was developed to render it useful with bags of various sized openings. Additionally, the refuse collecting device of the present invention is often used on lawns which may be wet or damp from dew, rainfall, etc. It is therefore encumbent upon the collection bag to be as protected as possible from tearing due to reduced strength after being wetted. Moreover, the collection bags, whether of paper or of plastic, will generally easily tear if the edges thereof catch upon obstructions such as roots, rocks, etc.

As depicted in FIG. 1, opening 35 of the collection bag encircles the rear of scoop 10. The lower edge of the opening, extending about the bottom portion of the scoop is disposed within a rearwardly opening guard 36 (see also FIGS. 2 and 3). Guard 36 includes a forward curved section 37 attached to the exterior surface of the scoop by welding, bonding or other means. A radially extended section 38 trails section 37 and defines, in conjunction with the exterior cylindrical surface of scoop 10, a channel 39. The rear edge 40 of section 38 may be bent radially outwardly.

One or several prongs may extend radially from the scoop to pierce and secure the overlying portion of the collection bag.

The function and purpose of channel 39 is that of slidably receiving the lower edge of the collection bag and, through section 38, protecting the edge of the bag from catching upon any surface discontinuities during operation of the refuse collecting device. The function and purpose of radially extended edge 40 is that of facilitating insertion of the edge of the collection bag within channel 39. It also serves a secondary function of deflecting any obstructions away from the trailing exposed surface of the collection bag extending rearwardly from the guard.

Clamping of the collection bag to the scoop is effected by a spring clamp 45 constructed from resilient material. The clamp includes attachment means 46, such as a sheet metal screw or a nut and bolt, for attaching the forward end of the clamp to the upper center line of the scoop. By convoluting clamp 45, as shown by convolution 47, the requisite resiliency and spring-like action of the clamp can be achieved. A downwardly extending section 48 bears toward exterior surface of scoop 10 and provides a clamping force upon any material inserted intermediate the clamp and the scoop surface. A collection bag piercing prong may be disposed on the clamp to lock the bag in place. Rear end 49 of the clamp may be bent upwardly to facilitate insertion of a part of the collection bag beneath the clamp.

To attach a collection bag to scoop 10, a portion of the bag opening is inserted within guard 38 and the diametrically opposed portion of the bag opening is forced intermediate clamp 45 and the underlying surface of the scoop. In the event the opening of the collection bag is greater in diameter than the diameter of exterior surface of the scoop, the bag is attached as described above and the excess of the bag material is drawn tight on one side or the other of clamp 45. The excess material is folded over adjacent the underlying portion of the bag and inserted beneath clamp 45; thereby, clamp 45 maintains the folded over portion 55 (see FIG. 1) in place to preclude expansion of the opening and disengagement of the bag from the scoop.

After the refuse to be collected has been retrieved by scoop 10 and slidably translated into collection bag 11, the upper end of the collection bag may be grasped by one hand, the other hand holding onto handle 20 of the scoop, and the bag is pulled rearwardly out of engagement with the scoop. Depending upon the holding power of clamp 45, it may or may not have to be lifted. Thereafter, the top of the bag can be folded or rolled over and disposal of the refuse bag may be undertaken. It may be noted that the only portion of scoop 10 coming in contact with the refuse during collection thereof is snout 12. No other external portion of the scoop necessarily contacts the refuse. After the refuse has been collected in collection bag 11, the bag is simply and readily disengaged from the scoop with no difficulty. Prior to the next use of the scoop, it may, of course, be cleaned, but such cleaning is not necessary to avoid manual contact with refuse remnants from the last use of the refuse collecting device.

From the above description, it will become apparent that the use of refuse collecting device 1 is equally facile whether handle 20 or handle 21 is employed during collection of the refuse. Additionally, removal of the collection bag can be equally well performed by simply grasping handle 21 and the refuse bag. However, it is anticipated that most users will prefer to hold onto handle 20 during both attachment and detachment of the collection bag.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A manually operated refuse collecting device for collecting refuse in a trailing disposable bag, said device comprising in combination:

a. a cylindrical scoop having the longitudinal axis thereof extending from the front to the rear for scooping refuse off a surface, said scoop including a forwardly extending snout disposed along the bottom thereof and a rear section for circumscribingly receiving the opening of the bag;

b. handle means secured to said scoop for manipulating said device;

c. a rearwardly opening guard having a front part secured to a lower cylindrical rear section of said scoop for protecting the bottom front edge region of the bag, said guard including a rear part radially extended from said scoop for defining a channel adjacent the lower bottom surface of said scoop for receiving and retaining the lower front edge region of the bag; and d. a resilient member disposed upon said scoop in general alignment with the longitudinal axis of said scoop and including clamp means for bearing against an upper front edge region of the bag to retain the bag attached about the exterior surface at the rear section of said scoop, said resilient member further including attachment means for securing the forward end of said resilient member to said scoop;

whereby, the bag is detachably attached to said scoop by said guard and said clamp means.

2. The device as set forth in claim 1 wherein said resilient member further includes at least one convolution for promoting the resilient characteristic of said resilient member.

3. The device as set forth in claim 2 wherein said handle means includes an extended handle having a pair of depending opposed wire elements pivotally secured to the front opposed sides of said scoop.

4. A manually operated refuse collecting device for collecting refuse in a trailing disposable bag, said device comprising in combination:

a. a cylindrical scoop having the longitudinal axis thereof extending from the front to the rear for scooping refuse off a surface, said scoop including a forwardly extending snout disposed along the bottom thereof and a rear section for circumscribingly receiving the opening of the bag;

b. handle means secured to said scoop for manipulating said device;

c. a rearwardly opening guard having a front part secured to a lower cylindrical rear section of said scoop for protecting the bottom front edge region of the bag, said guard including a rear part radially extended from said scoop for defining a channel adjacent the lower bottom surface of said scoop for receiving and retaining the lower front edge region of the bag; and d. a resilient member having a forward end and a rearward end, said forward end including attachment means for securing said resilient member to said scoop, said rearward end including a contact point bearing against the underlying surface of said scoop for clamping the front edge region of the bag against said scoop;

whereby, the bag is detachably attached to said scoop by said guard and said clamp means.

5. The device as set forth in claim 6 wherein said handle means includes an extended handle having a pair of depending opposed wire elements pivotally secured to the front opposed sides of said scoop.

6. The device as set forth in claim 4 wherein said handle means comprises a rigid handle extending from said scoop.

* * * * *

UNITED STATES PATENT AND TRADEMARK OFFICE

CERTIFICATE OF CORRECTION

PATENT NO. : 4,149,745

DATED : April 17, 1979

INVENTOR(S) : J. Don Willis

It is certified that error appears in the above–identified patent and that said Letters Patent are hereby corrected as shown below:

In Column 6, Claim 5, line 1, delete "6" and substitute therefor --4--.

Signed and Sealed this

*Twenty-first* Day of *August 1979*

[SEAL]

*Attest:*

*Attesting Officer*

LUTRELLE F. PARKER

*Acting Commissioner of Patents and Trademarks*